US005524997A

United States Patent [19]

von Rohrscheidt

[11] Patent Number: 5,524,997

[45] Date of Patent: Jun. 11, 1996

[54] SHEET BINDER

[76] Inventor: Friedrich von Rohrscheidt, 2210 Walhala Dr., Richmond, Va. 22336

[21] Appl. No.: 342,048

[22] Filed: Nov. 17, 1994

[30] Foreign Application Priority Data

Sep. 29, 1994 [DE] Germany ..... 44 34 769.3

[51] Int. Cl.[6] ..... B42F 13/02

[52] U.S. Cl. ..... 402/19; 402/70; 402/73

[58] Field of Search ..... 402/19, 21, 70, 402/73, 75

[56] References Cited

U.S. PATENT DOCUMENTS

| | | | |
|---|---|---|---|
| 1,005,423 | 10/1911 | Elder | 402/8 |
| 2,170,260 | 8/1939 | Cruzan | 402/19 |
| 2,176,314 | 10/1939 | Russell . | |
| 2,202,097 | 5/1940 | Farkas . | |
| 2,242,185 | 5/1941 | Spinner | 281/27.1 |
| 2,285,234 | 6/1942 | Tauber . | |
| 2,299,061 | 10/1942 | Spinner | 281/27.2 |
| 2,363,848 | 1/1943 | Emmer | 402/31 |
| 2,407,656 | 9/1946 | Emmer . | |
| 2,489,706 | 11/1949 | Emmer | 402/21 |
| 2,602,542 | 7/1952 | Spinner . | |
| 2,747,577 | 5/1956 | Freundlich . | |
| 2,891,552 | 6/1959 | Trussell | 402/22 |
| 2,935,986 | 5/1960 | Pluckebaum | 402/19 |
| 3,433,688 | 2/1966 | Staats et al. | 156/85 |
| 4,120,517 | 10/1978 | Staats | 281/19.1 |
| 4,577,889 | 3/1986 | Schulz . | |
| 4,941,804 | 7/1990 | Sarpy, Jr. | 412/7 |

FOREIGN PATENT DOCUMENTS

| | | | |
|---|---|---|---|
| 1057565 | 3/1954 | France | 402/19 |
| 635775 | 9/1936 | Germany | 402/70 |
| 308584 | 10/1955 | Germany | 402/19 |
| 1906028 | 12/1964 | Germany . | |
| 1296604 | 6/1969 | Germany . | |
| 2340129 | 2/1974 | Germany . | |
| 2706371 | 9/1977 | Germany . | |
| 431454 | 3/1967 | Switzerland . | |
| 483709 | 4/1938 | United Kingdom | 402/70 |
| 1436417 | 5/1976 | United Kingdom . | |
| 1569497 | 6/1980 | United Kingdom . | |

*Primary Examiner*—David P. Bryant
*Attorney, Agent, or Firm*—Jacobson, Price, Holman & Stern

[57] ABSTRACT

A binder made from a single piece of injection molded plastic material. The binder includes an elongated dorsal part having a first lateral side and a second lateral side. A plurality of fingers are formed integrally with and extend from the first side of the dorsal part. Each of the fingers has a free end. The fingers curl toward the second side to form rings which extend through holes in the sheets to secure the sheets on the binder. A plurality of teeth are formed integrally with and are spaced along the second side of the dorsal part. The free ends of the fingers extend close enough to the first side of the dorsal part to prevent the sheets from unintentionally sliding out of the binder. Optionally, the punch binder includes a spine removably disposed along a length of the dorsal part for preventing the fingers and teeth from separating. The spine can be attached to both the dorsal part and to the ring-shaped fingers or to only one of the two.

12 Claims, 4 Drawing Sheets

SHEET BINDER

BACKGROUND OF THE INVENTION

1. Field of the Invention

The present invention relates to a one-piece injection molded binder for securing together a plurality of sheets.

2. Description of the Related Art

Conventional one-piece binders include a longitudinal dorsal part and fingers spaced along the dorsal part. The fingers form rings which run through punch holes in the sheets to secure the sheets together. The dorsal part and the rings are made of a single piece of flexible plastic. The fingers overlap the dorsal part, so the sheets cannot slide and fall out of the rings.

The above-described binders are conventionally punched out of sheets of polyvinylchloride (PVC), then heated and rolled into a cylindrical shape. In the cutting process, approximately 15 percent of the initial sheet material is lost as surplus as a result of cutting the sheets into strips, punching the binders, and cutting the binders to length. PVC is the best suited material for the punching and rolling process, but it poses serious environmental issues since it creates hazardous gases when incinerated.

The round profile of the binder created through the above-noted rolling process causes the stack of bound sheets to have a convex profile, particularly when large diameter binders are employed. This phenomenon detracts from the aesthetics of the finished bound document, because the unbound edge assumes the convex shape of the round binding material, such that the bound material often extends beyond the cover and the back of the binder.

SUMMARY OF THE INVENTION

The present invention overcomes the deficiencies of the prior art by providing a binder formed of a single piece of injection molded plastic material. The binder includes an elongated dorsal part having a first lateral side and a second lateral side. A plurality of fingers are formed integrally with and extend from the first lateral side of the dorsal part. Each of the fingers has a free end. The fingers are curled to form rings which extend through holes in the sheets to secure the sheets on the binder. A plurality of teeth are formed integrally with and are spaced along the second lateral side of the dorsal part. The free ends of the fingers fit between the spaced teeth and extend close enough to the second side of the dorsal part to prevent the sheets from unintentionally sliding out of the binder.

In one embodiment, the free ends of the fingers are spaced from the second side of the dorsal part to form a slot therebetween. In another embodiment, the free ends of the fingers overlap the second side of the dorsal part.

A spine, which prevents the sheets from slipping out of the rings, is removably disposed along a length of the dorsal part for preventing the fingers and teeth from separating. The spine can be attached to both the dorsal part or the ring-shaped fingers or only to one of the two.

The present invention also relates to a process for manufacturing a binder made of a one-piece injection molded plastic, which remains flexible when cured.

Advantageously, manufacturing the binder through injection molding results in a savings of material of approximately 15 percent, in comparison with the conventional punching process. All scrap material can be reused in the injection molding process.

Still another advantage is the process for manufacturing elastic binders made of an injection moldable plastic. Using this manufacturing process it is possible to produce the binders economically and to dispose of the binders in an environmentally sound way. Since plastic granulate is used as the basic material instead of plastic sheets, one manufacturing step, i.e., the step of producing the plastic sheets is eliminated. A plurality of types of injection moldable plastic is suitable, as long as the plastic remains flexible when cured.

The injection molded binder of the present invention can be made in any desired profile, i.e., rectangular, elliptical, or triangular. Thereby aesthetically appealing and unique profiles of the binder and the stack of paper can be achieved, facilitating printing and identification. By injection molding the binder its profile can be chosen in a way that saves an additional 10 percent of the material.

Other features and advantages of the present invention will become apparent from the following description of the invention which refers to the accompanying drawings.

DETAILED DESCRIPTION OF THE PREFERRED EMBODIMENTS

Figure 1:
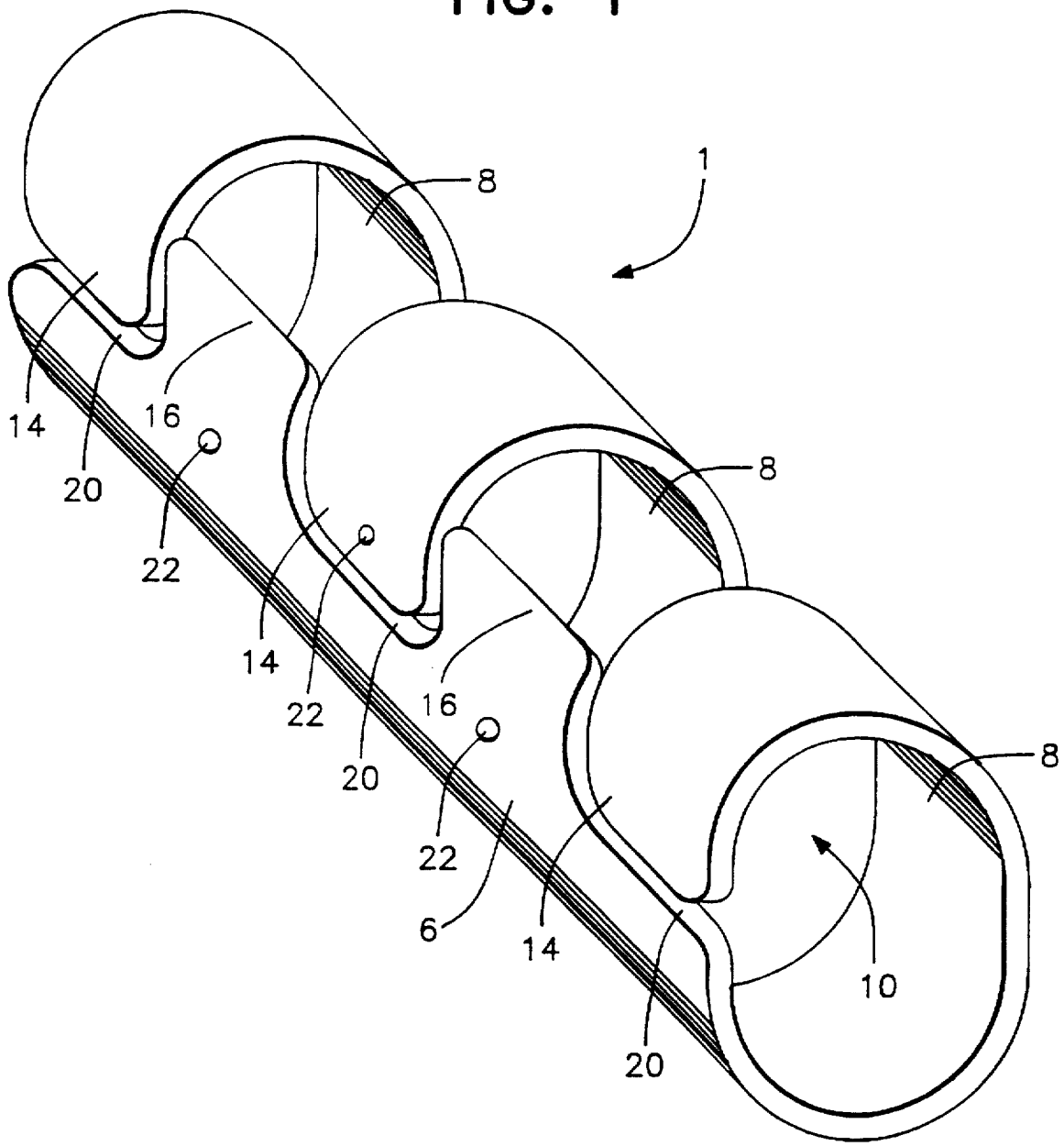
FIG. 1 is a perspective view of one embodiment of the binder in accordance with the present invention.

Referring to FIG. 1, the binder of the present invention includes a longitudinal dorsal part 6 formed with a plurality of fingers 8 which are spaced along the dorsal part 6 and extend rectilinearly therefrom. The fingers 8 are curved, such that they form a ring 10.

Dorsal part 6 also includes a plurality of spaced apart teeth 16 which extend rectilinearly from the dorsal part 6 in an opposite direction to fingers 8. As shown in FIG. 1, fingers 8 fit into the spaces between teeth 16 in dorsal part 6.

Dorsal part 6, fingers 8 and teeth 6 are made from a single piece of plastic by injection molding. Injection molding the binder results in a savings of raw materials in comparison to the conventional punching process. Scrap parts and all other plastic surplus can be reused in the injection molding process.

Since plastic granulate is used as a basic material, instead of plastic sheets, the step of producing the plastic sheets during the manufacturing process is eliminated. As a raw material, however, any injection moldable material which is elastic when cured is suited. Preferably, polyethylene is used. Polyethylene is more environmentally sound than PVC, since no hazardous gases are created during incineration. However, for reasons of its low cost, PVC can also be used.

One further advantage of the injection molding process is that the binder can be produced in any desirable profile, e.g., square, round, elliptic, or triangular by means of the mold design. According to the preferred profiles depicted in the drawings, the binder is flattened on the side where the sheets are inserted in order to give the stack of sheets a square edge.

The binder is designed in a way so that it can be easily and economically produced by injection molding. Therefore, the fingers 8 are formed so that ends 14 do not overlap with the dorsal part 6, since an overlap would require a complicated and expensive injection molding tool. However, in principle, an overlap is also possible. The injection molding tool would then include an offset.

Figure 2:
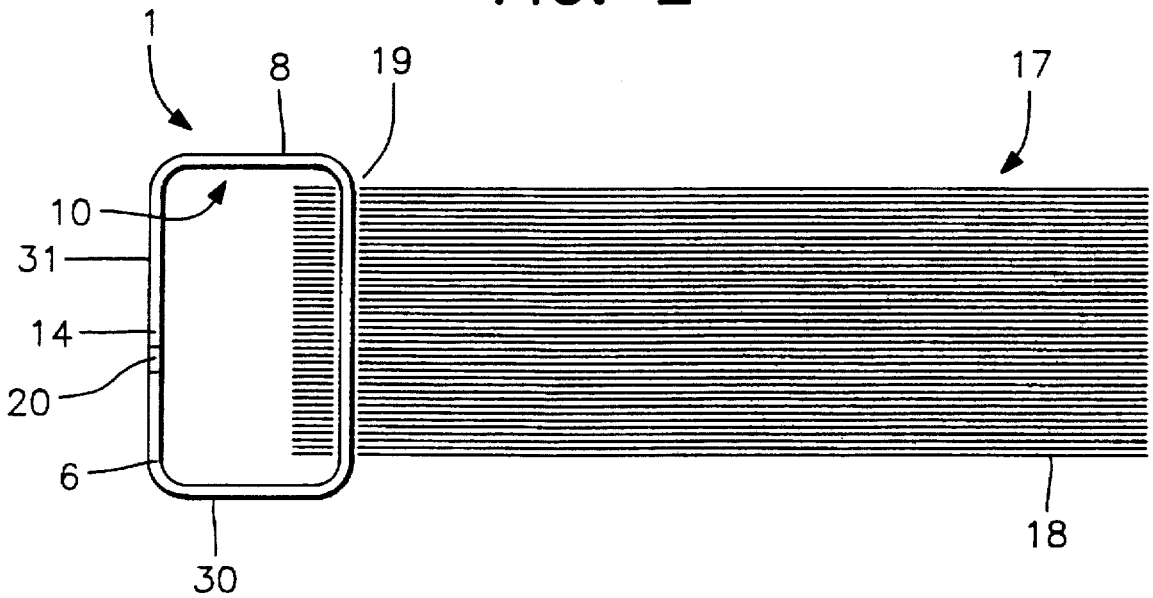
FIG. 2 is a cross-section of a second embodiment of the binder in accordance with the present invention, wherein the binder is shown securing together a stack of sheets.

As shown in FIG. 2, the binder 1 secures a stack 17 of sheets 18. Sheets 18 can be made of paper, plastic or cardboard. In the preferred embodiment shown in the drawings, the binder secures together sheets 18 of paper. The binder shown in FIG. 1 has a semi-oval profile, while the binder in FIG. 2 has a rectangular profile, enabling the stack of paper to form a neat, rectangular shape.

Since the plastic material of the binder is flexible, the fingers 8 spring back into their initial curved shape (interlocking with teeth 16) after being opened and released, thus holding the stack 17 of sheets 18 together. The fingertips 14 extend close to dorsal part 6 so the sheets 18 cannot slide out unintentionally.

As shown in FIGS. 1–4, in the closed state of the binder there is a small slot 20 between the fingertips 14 and the rim of the dorsal part 6. This small slot 20 is located on the side of the binder that is opposite to the stack of paper 17. Since the slot 20 is at a different elevation than the stack of paper 17 due to the teeth 16, no pages 18 can fall through the slot 20 and out of the binder when a person is reading through the stack 17.

Figure 3:
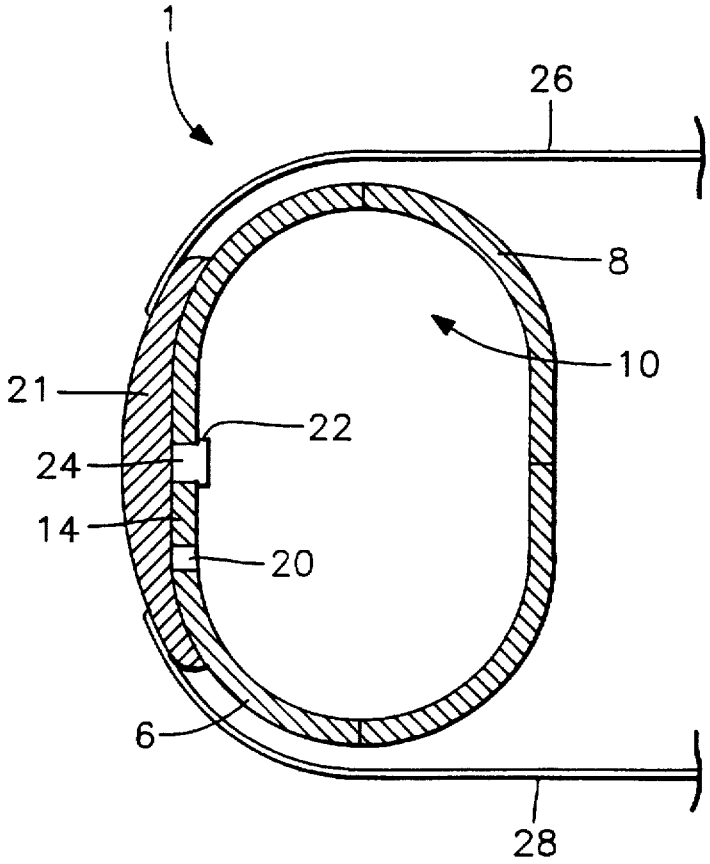
FIG. 3 is a cross-section of the binder of FIG. 1, with a spine affixed thereto.

Referring to FIG. 3, binder 1 is equipped with a spine or plate 21 along dorsal part 6. Binder 1 has holes 22, into which studs 24 of the spine 21 can be plugged into. However, the spine 21 can also be connected to the dorsal part 6 and the fingers 8 by other means, e.g., by gluing or high frequency welding. The spine 21 can be attached to both the dorsal part 6 and to the ring-shaped fingers 8 or only to one of the two.

Spine 21 improves the aesthetics of the binder and also provides an area for printing or embossing. As a safety feature, spine 1 covers the slot 20 between the fingers 8 and the dorsal part 6 and prevents any separation of the fingers 8 from the dorsal part 6. Spine 21 can be produced by cutting, punching, or injection molding. In order to color code bound stacks 17, the spines 21 can be produced in different colors. Therefore, the binders themselves only need to be produced in one color.

The embodiment of the binder according to FIG. 3 has two cover sheets which are connected to spine 21. One cover sheet 26 covers the upper side of stack 17 and the other cover sheet 28 covers the lower side of stack 17. Preferably, the top cover sheet 26 is made of a transparent plastic, while the bottom cover sheet 28 is made of cardboard. The cover sheets 26 and 28 can also be made in one piece, in which case the sheets are wrapped around the back of the stack and connected to spine 21. In another design variant, the two cover sheets 26 and 28 and the spine 21 are made from a single piece of plastic, or the cover sheets 26 and 28 can be directly attached to the dorsal part 6 and/or to the fingers 8.

Figure 4:
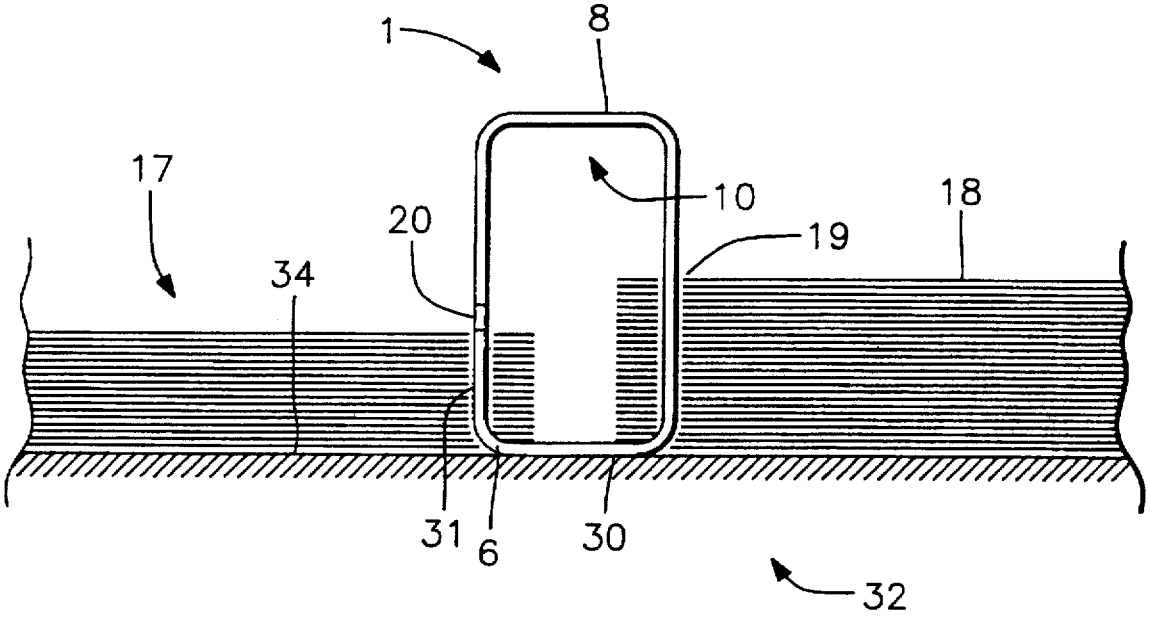
FIG. 4 is a cross-section of the embodiment of FIG. 2 with the bound report opened, e.g., for copying.

Referring to FIG. 4, when the bottom part 30 of the circumference 31 of the binder 1 is flat, it is possible to position the sheets perfectly flat on the surface plate 34 of a photocopying machine 32. When the unit is inverted in the copy position, fingers 8 and dorsal part 6 do not misalign paper sheets 18, allowing undistorted photocopying.

Figure 5:
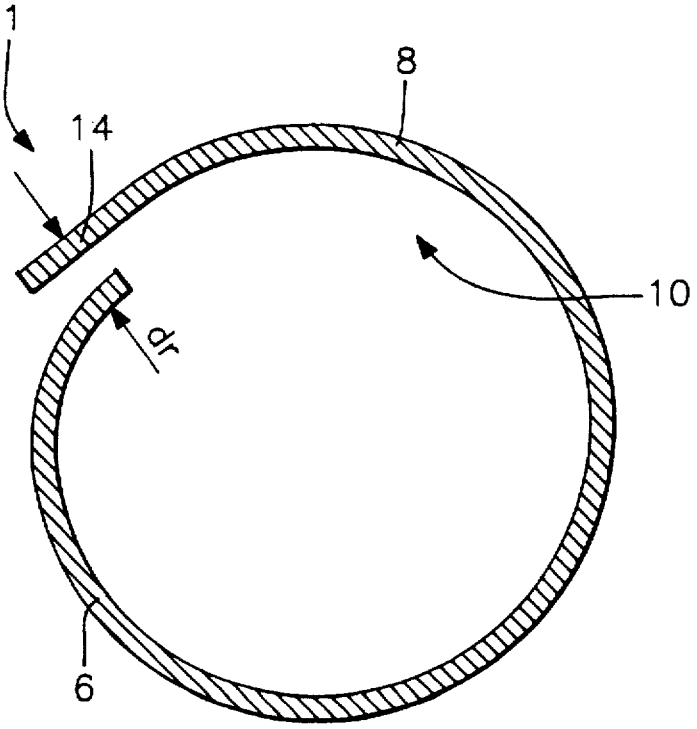
FIG. 5 is a cross-section of another embodiment of the binder according to the present invention.

FIG. 5 shows another design variant of the binder 1 according to the invention, in which the fingertips 14 and the dorsal part 6 overlap with a radial gap or which is perpendicular to the cross-section of the binder.

Figure 6:
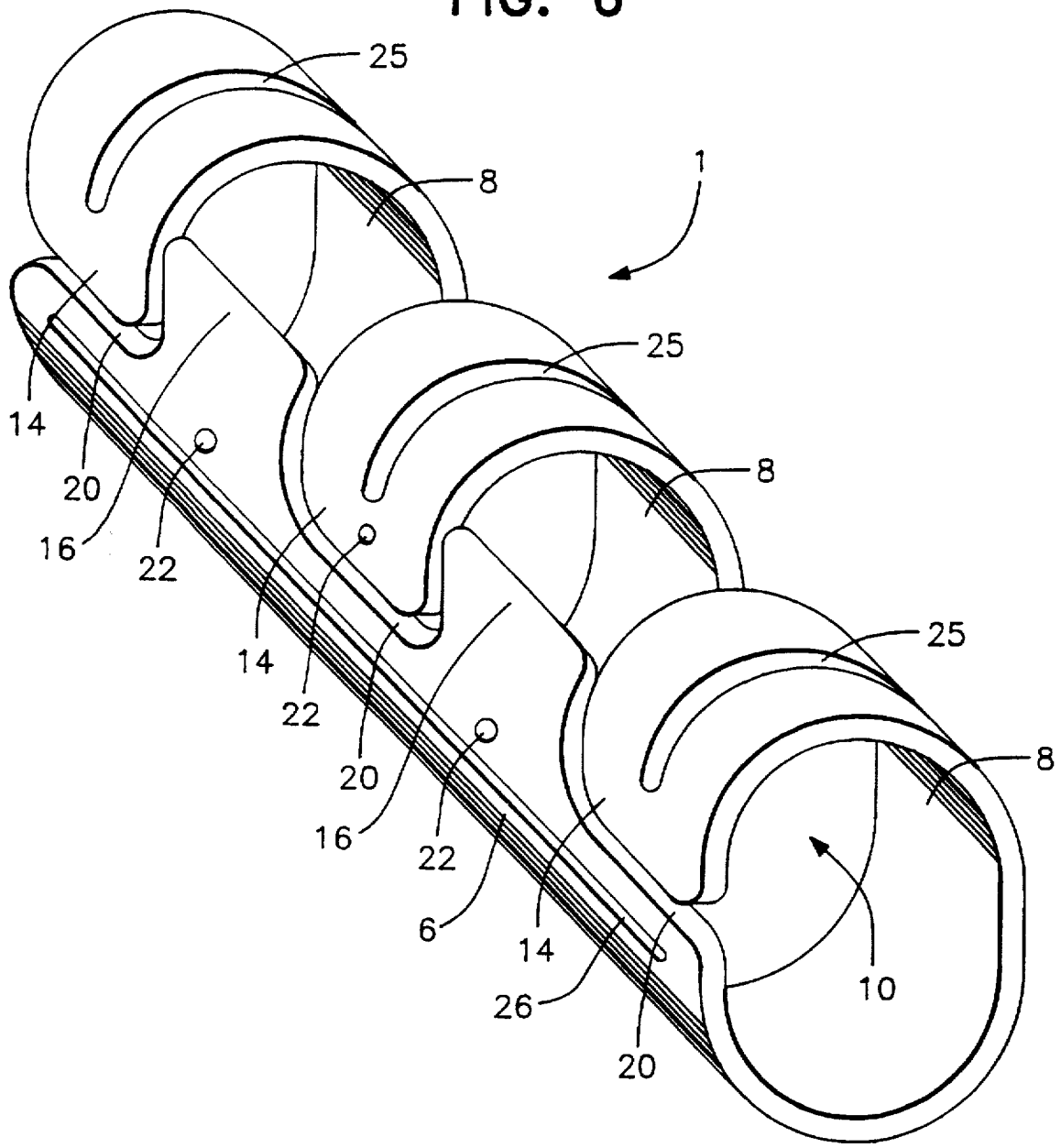
FIG. 6 is a perspective view of an alternative embodiment of the binder of the present invention in which the fingers and/or the dorsal part are provided with reinforcement ribs.

FIG. 6 shows another a further design variant of the binder 1 of the present invention, in which reinforcement ribs 25 are added to the fingers 8 to increase the resistance of the binder against opening. Additionally, as shown in FIG. 6, reinforcement ribs 26 can be added to the dorsal part 6 to increase the longitudinal bending resistance of the binder. Ribs 25 and 26 are formed by varying the thickness of the material of a binder in the injection molding process. It is not possible to vary the thickness of the binder material with the state of the art punching and rolling process, which uses sheet material of equal thickness.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An elongated binder for securing a stack of sheets said binder having a longitudinally extending central axis, comprising:

an elongated dorsal part having a first lateral side and a second lateral side;

a plurality of flexible fingers formed integrally with and extending from the first lateral side of the dorsal part, each of the fingers having a free end and substantially parallel straight side edges that lie in planes substantially perpendicular to said central axis, wherein the fingers are curled and are insertable through holes in the sheets to secure the sheets on the binder, said fingers and said dorsal part forming a plurality of rings, said fingers forming the majority of the perimeter of their respective rings; and a plurality of teeth formed integrally with and spaced along the second lateral side of the dorsal part opposite the first lateral side, each of said teeth fitting between adjacent fingers and extending adjacent to the straight side edges of the adjacent fingers, said fingers having free ends which extend close to the second lateral side of the dorsal part but not in contact therewith, said fingers resiliently movable with respect to the second lateral side of the dorsal part.

2. The binder as recited in claim 1, wherein the binder is formed of an injection moldable plastic material which remains flexible when cured.

3. The binder as recited in claim 2, wherein the plastic material is polyethylene.

4. The binder as recited in claim 1, wherein the rings have a non-circular shape.

5. The binder as recited in claim 4, wherein the non-circularly shaped rings are flattened on a side extending through the holes of the sheets such that the sheets in the binder form a stack with a square edge.

6. The binder as recited in claim 1, wherein the fingers are provided with reinforcement ribs.

7. The binder as recited in claim 1, wherein the dorsal part is provided with a reinforcement rib.

8. The binder as recited in claim 7, wherein the reinforcement rib is substantially parallel with said central axis.

9. The binder as recited in claim 1 wherein each of said plurality of teeth have substantially straight side edges that lie in planes substantially perpendicular to said central axis, said teeth side edges adjacent to and substantially parallel with said straight side edges of said fingers.

10. The binder as recited in claim 9 wherein said straight edges are spaced from the fingers and form gaps therebetween.

11. The binder as recited in claim 1 wherein said fingers are continuously curled to form, with said dorsal part, a plurality of substantially rounded rings.

12. The binder as recited in claim 1 wherein each of said plurality of teeth have a free end portion that is substantially straight and lies parallel to said central axis of said binder.

* * * * *